US008602417B2

(12) United States Patent
Farrow

(10) Patent No.: US 8,602,417 B2
(45) Date of Patent: Dec. 10, 2013

(54) MODIFIED BLACKJACK GAME AND METHOD

(71) Applicant: Ronald Farrow, San Antonio, TX (US)

(72) Inventor: Ronald Farrow, San Antonio, TX (US)

(73) Assignee: R & J Gaming Incorporated, San Antonio, TX (US)

( * ) Notice: Subject to any disclaimer, the term of this patent is extended or adjusted under 35 U.S.C. 154(b) by 0 days.

(21) Appl. No.: 13/781,163

(22) Filed: Feb. 28, 2013

(65) Prior Publication Data

US 2013/0178266 A1 Jul. 11, 2013

Related U.S. Application Data

(63) Continuation-in-part of application No. 12/695,875, filed on Jan. 28, 2010, now abandoned.

(60) Provisional application No. 61/147,943, filed on Jan. 28, 2009.

(51) Int. Cl.
*A63F 1/00* (2006.01)

(52) U.S. Cl.
USPC ..... 273/292

(58) Field of Classification Search
USPC ..... 273/292
See application file for complete search history.

(56) References Cited

U.S. PATENT DOCUMENTS 3,781,163 A * 12/1973 Ovens ..... 431/266
5,743,532 A * 4/1998 Lafferty ..... 273/292
6,074,786 A * 6/2000 Chiang ..... 430/5
6,113,102 A * 9/2000 Marks et al. ..... 273/292
6,158,741 A * 12/2000 Koelling ..... 273/292
6,302,396 B1 * 10/2001 Eaton et al. ..... 273/274
6,481,718 B2 * 11/2002 Koelling ..... 273/292
6,536,767 B1 * 3/2003 Keller ..... 273/292
6,609,711 B1 * 8/2003 Campbell ..... 273/274
6,796,896 B2 * 9/2004 Laiti ..... 454/229
6,796,898 B1 * 9/2004 Timpano ..... 463/12
7,000,921 B2 * 2/2006 Schultz ..... 273/292
7,207,563 B2 * 4/2007 Samberg ..... 273/292
7,222,854 B2 * 5/2007 Sorge ..... 273/292
8,251,798 B2 * 8/2012 Belger et al. ..... 463/20
8,264,448 B2 * 9/2012 Shteynberg et al. ..... 345/102
8,286,967 B2 * 10/2012 Sparago ..... 273/292
8,287,346 B2 * 10/2012 Miller ..... 463/13
8,308,559 B2 * 11/2012 Chun ..... 463/31
8,317,199 B2 * 11/2012 Hall ..... 273/292
8,342,525 B2 * 1/2013 Scheper et al. ..... 273/149 R
8,342,528 B2 * 1/2013 Porto ..... 273/292
8,360,434 B2 * 1/2013 Smith et al. ..... 273/292

(Continued)

*Primary Examiner* — Kurt Fernstrom
*Assistant Examiner* — Dolores Collins

(57) ABSTRACT

An electronic gaming system for playing a modified Blackjack game, which system includes a one video monitor; a processor, a computer-readable medium; and a player input means. The system offers the players at least one side bet having an outcome dependent upon whether a card yet to be dealt will belong to a player-selectable subset of a set of predetermined traits of the card (such as the identifying color, traditional suit, or ranking); accepts from the players any wagers and selections of the player-selectable subsets; deals a card to each player and the dealer from a specialized deck of cards; determines whether the value of the predetermined trait of the relevant card belongs to the player-selected subset; for each accepted side bet, determining whether there is an overriding losing condition present; for each successful side bet, paying the player a predetermined payout; and, finally, completes the Blackjack game.

8 Claims, 4 Drawing Sheets

(56) References Cited

U.S. PATENT DOCUMENTS 8,360,839 B2 * 1/2013 Stroll ..... 463/12
8,382,113 B2 * 2/2013 Costa ..... 273/292
2009/0051110 A1 * 2/2009 Sparago ..... 273/236

* cited by examiner

MODIFIED BLACKJACK GAME AND METHOD

CROSS REFERENCE TO RELATED APPLICATIONS

This is a continuation-in-part application claiming the benefit of the filing date of U.S. application Ser. No. 12/695,875, filed Jan. 1, 2010, which claims the benefit of the filing date of U.S. provisional application No. 61/147,943, filed Jan. 28, 2009. Each of these applications is incorporated by reference into this application.

STATEMENT REGARDING FEDERALLY SPONSORED RESEARCH OR DEVELOPMENT

Not applicable.

BACKGROUND OF THE RELATED ART

1. Field of the Invention

The present invention relates to a card game and method of playing a card game. More specifically, the present invention is a modified Blackjack game and method wherein the game includes at least one optional side bet, the outcome of which is dependant on one or more characteristics of a card of a Blackjack hand.

2. Description of the Related Art

A number of United States patents disclose variations of card games. For example, U.S. Pat. No. 5,979,897 (issued Nov. 9, 1999) discloses a method for playing a modified form of Blackjack with rules variations to increase the excitement of the game while retaining substantially the same "take." Specifically, the '897 patent provides, among other things, (i) for a payout of 2:1 for a blackjack of a specified suit; (ii) that five or more cards totaling exactly 21 pays 2:1; (iii) that six cards totaling twenty or more pays 1:1; and (iv) the player may place a "side bet" on getting a blackjack in a designated suit in the first round of a newly shuffled deck, which, if successful, pays 300:1.

U.S. Pat. No. 6,322,075 (issued Nov. 27, 2001) provides for a "Blackjack-type game" in which each player receives four playing cards arranged in a window, with two of the cards face-up and two of the cards face-down. Wagers are made on at least one and at most three of the six possible different two-card combination of the array, betting against the dealer's hand, which is governed by traditional Blackjack rules. A player forfeits his initial wager in the event that his cards contain a certain predetermined losing hand, whereas a bonus winning payout is made on the initial wager if the player's cards contain a certain predetermined winning hand.

U.S. Pat. No. 6,536,767 (issued Mar. 25, 2003) provides a variation of Blackjack wherein a player may make a side bet on a dealer's face up card having a point value of ten and a plurality of side bets relating to a player's first two dealt cards.

U.S. Pat. No. 6,877,746 (issued Apr. 12, 2005) discloses a Blackjack game wherein players are afforded the option of exchanging one or more of the players' dealt cards. Each player is given the option of exchanging one or both of an originally dealt two cards for a predetermined fee (e.g., 50% of the initial wager).

U.S. Pat. No. 7,222,854 (issued May 29, 2007) provides a modified Blackjack game in which every player places a first wager, the outcome of which is determined by conventional Blackjack rules. Players may optionally place an additional wager corresponding to a predicted total point value or point value range of an initial hand of two cards dealt to the player.

After the dealer has dealt a player that has placed the additional wager a second card, an actual total point value is computed for the two-card hand of that player. If the actual total point value is equal to or in a range of a predicted total point values, a player placing an additional wager wins a predetermined multiple of the amount of the additional wager. A second predetermined multiple may be paid if a player's two card hand includes two cards of the same suit.

U.S. Pat. No. 7,435,172 (issued Oct. 14, 2008) discloses a modification to a card game in which bets are pushed if the total of the cards in the player's and dealer's hands are of equal value and add up to twenty-one or less, or if the total of the cards in the dealer's hand equals a predetermined value between twenty-two and twenty-six and the total of the cards in the Each of the above-referenced United States patents and/or published applications is hereby incorporated by reference herein.

BRIEF SUMMARY

The present invention is a modified Blackjack game between a dealer and one or more players that incorporates at least one side bet available to each player. The method comprises: offering the players at least one side bet having an outcome dependant upon whether a card yet to be dealt will belong to at least one subset of a set of predetermined traits of the card (such as the identifying color, traditional suit, or ranking); accepting from the players any wagers and selections of the subsets; dealing a card to each player and the dealer from a deck of cards, wherein each card composing the deck comprises at least one predetermined trait; for each accepted side bet, determining whether the predetermined trait of the relevant card belongs to the selected subset; for each accepted side bet, determining whether there is a overriding losing condition present; for each successful side bet, paying the player a predetermined payout; and, finally, completing the Blackjack game.

With the present invention, the underlying game of Blackjack remains unchanged except to the extent the pace of the game may be changed to allow for the betting and resolution of any desired side bets. A player's blackjack wager is not affected by the wager on any side bets.

DETAILED DESCRIPTION OF VARIOUS EMBODIMENTS

A Preferred Embodiment

Figure 1:
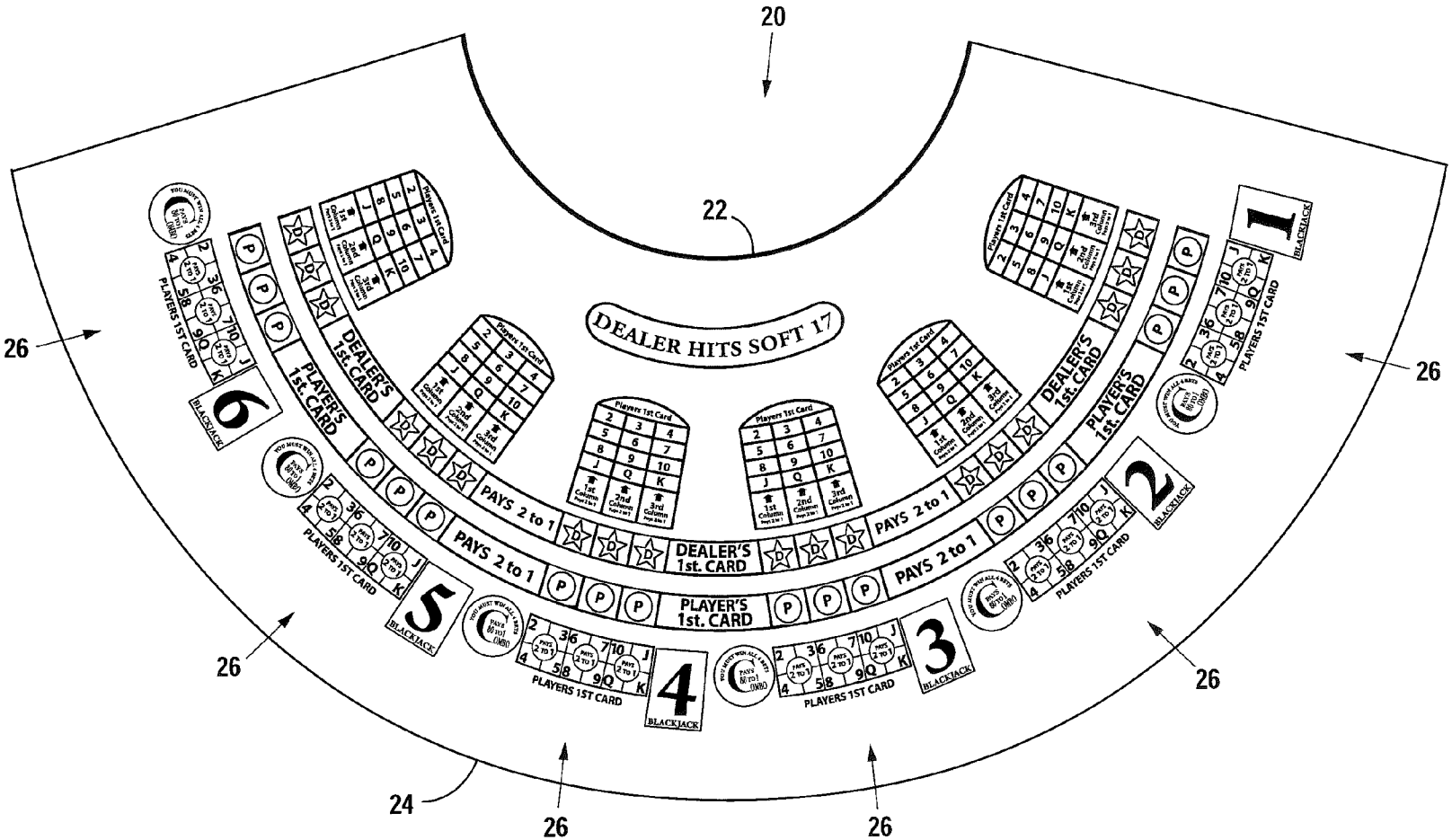
FIG. 1 shows the layout of a gaming table comprising the card game of the preferred embodiment of the present invention.

The preferred embodiment of the present invention is a modified Blackjack game that provides one or more players the opportunity to place additional proposition wagers (i.e., "side bets") on the cards received from and/or dealt to the dealer. As shown in FIG. 1, a gaming table 20 having a dealer side 22 and a player side 24 provides a number of stations 26 for players to occupy, which is typically five or six stations per gaming table 20.

Figure 2:
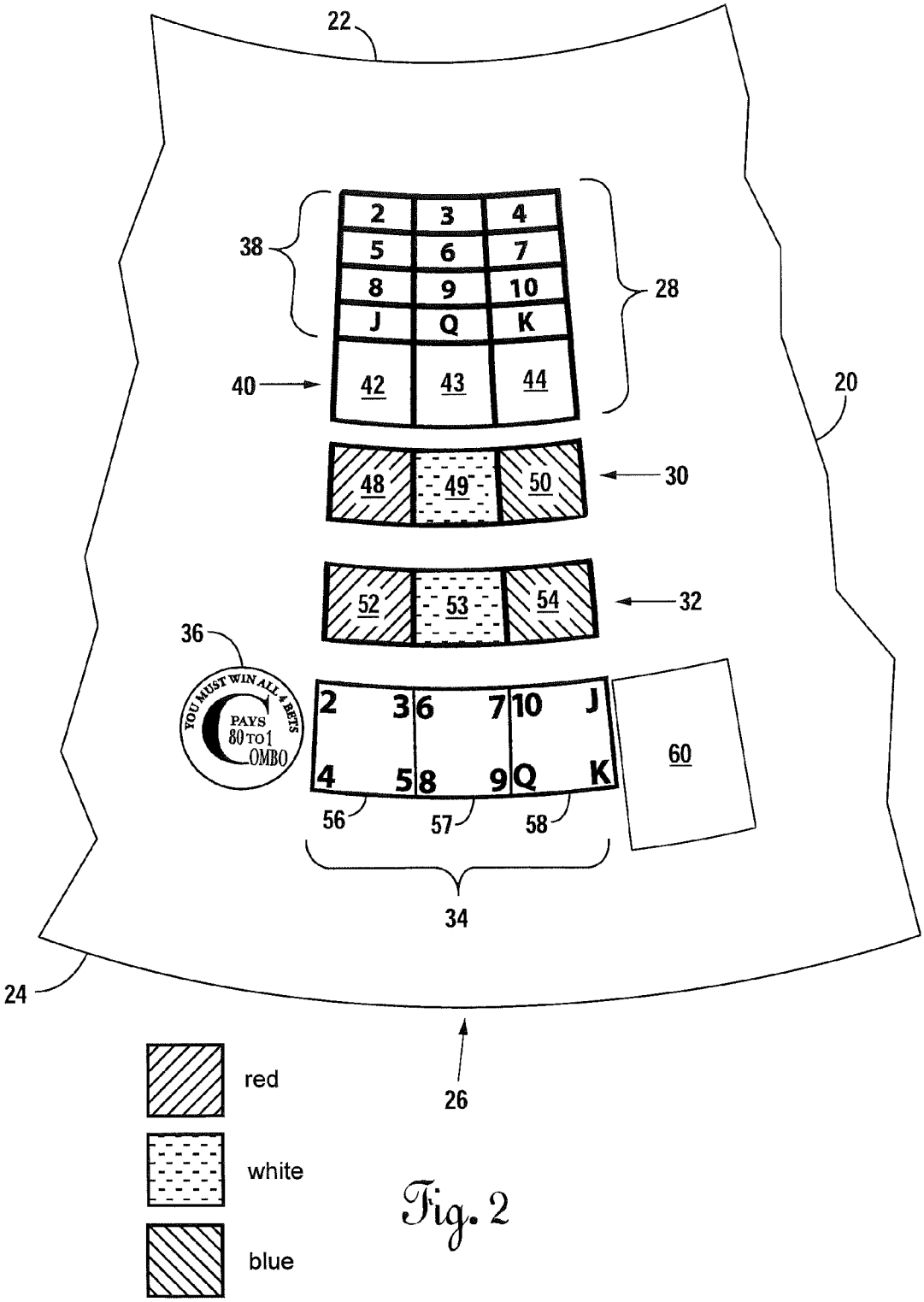
FIG. 2 shows a specific playing station of the gaming table shown in FIG. 1.

As shown more fully in FIG. 2, in which some markings shown in FIG. 1 have been removed for clarity, at each station 24 is a first wagering area 28, a second wagering area 30, a third wagering area 32, a fourth wagering area 34, and a fifth wagering area 36 corresponding to optional first, second, third, fourth, and fifth side bets.

The first wagering area 28, which is the wagering area most proximal to the dealer side 22, is subdivided into fifteen rectangular areas in three columns having five rows. Each ranking of a traditional playing card suit, except for the ace, is placed in one of twelve rectangular areas that compose four rows 38, with no more than one ranking within each rectangular area. The left column (when viewed from the playing position) includes the first subset of rankings two, five, eight, and jack (J); the center column includes the second subset of rankings of three, six, nine, and queen (Q); and the right column includes the third subset of rankings of four, seven, ten, and king (K). The first row 40 consists of three adjacent betting windows 42-44 within their respective columns, each window thus being associated with one of the first, second, and/or third subsets.

The second wagering area 30 comprises three adjacent betting windows 48-50. For aesthetic purposes, each of the windows 48-50 is aligned with either the left, center, or right columns composing the first wagering area 28. Each of the betting windows 48-50 of the second wagering area 30 is differently colored: the left window 48 is red; the center window 49 is white, and the right window 50 is blue.

The third wagering area 32 comprises of three adjacent betting windows 52-54. For aesthetic purposes, each of the windows 52-54 is aligned with the left, center, or right betting windows 48-50 that compose the second wagering area 30. Each of the betting windows 52-54 of this wagering area is differently colored: the left window 52 is red; the center window 53 is white, and the right window 54 is blue.

The fourth wagering area 34 comprises three adjacent betting windows 56-58. Each of the betting windows 56-58 contains four card rankings corresponding to a ranking of a traditional playing deck. All rankings of a suit are present within the fourth wagering area 34 except for the ace: the left window 56 includes the subset of rankings two through five; the center window 57 includes the subset of rankings six through nine, and the right window 58 includes the rankings ten through king (10, J, Q, K). No ranking appears in the fourth wagering 34 area more than once.

The circular fifth wagering area 36 is located to the left of and proximal to the fourth wagering area 34.

A Blackjack betting window 60 for traditional Blackjack wagers is located to the right of the fourth wagering area 34.

In this preferred embodiment, thirty-nine cards make up a complete playing deck, which is divided into three suits (ace through king), with all cards of each suit except the ace having a common identifying trait that is one of the colors of red, white, and blue. The ace of each suit, however, is green. Although this specific embodiment contemplates the use of red, white, blue, and green as set forth above, any other combination of colors is acceptable, provided that (i) the identifying colors preferably are quickly distinguishable from one another; (ii) a specific color is not used in more than one window in a single wagering area; and (iii) the identifying colors of the cards correspond to the colors used to identify the betting windows within the wagering areas when applicable—i.e., in the preferred embodiment, the second and third wagering areas.

Alternatively, rather than identifying colors, the traditional card suits may be used (i.e., hearts, spades, diamonds, clubs). Those skilled in the art will recognize that alternative identifying traits may also be used.

The preferred method of the present invention includes the traditional rules of Blackjack, wherein at least two cards are dealt to each player and the dealer, and the players attempt to exceed or tie the value of the dealer's hand without the player's own hand exceeding a value of twenty one (i.e., "busting"). Although described herein with reference to a dealer and a single player, it should be understood that multiple players may play at any time with a single dealer.

The preferred method provides the opportunity for a player to make up to five additional side bets on ranking and/or identifying color of the first card dealt to the player and the first card dealt to the dealer. Prior to any cards being dealt, each player is offered the opportunity to optionally make one or more side bets having outcomes determined by the first card to be dealt to the player and the first card dealt to the dealer. After all desired side bets are placed, the players and dealer are dealt the first card of their Blackjack hand face up, and any side bets that were placed then resolved. Regular Blackjack play thereafter resumes.

In the preferred embodiment, the green aces have special significance with respect to the side bets, but have normal Blackjack significance after side bets are resolved and Blackjack play resumes. First, when a green ace is dealt to the player, only that player loses all side bets on which he has placed a wager, but not his Blackjack wager. Second, when a green ace is dealt to the dealer, all players lose their side bets in which a wager has been placed, but not their Blackjack wager. The Blackjack wager does not come into play until the second card is dealt face up to the player and a second card is dealt to the dealer face down, after which Blackjack play resumes and any green ace in play has its normal Blackjack significance of having a value of either one or eleven.

The first optional side bet provides a wagering opportunity based on whether the ranking of the player's card will belong to one of three subsets of rankings of the first wagering area 28. Referring to FIG. 1, to wager that the player's first card will have a ranking of two, five, eight, or jack (J) (i.e., the first subset of rankings), the player positions a wager (e.g., a colored chip having a predetermined monetary value) within the left betting window 42 of the first wagering area 28. To wager that the player's first card will be a three, six, nine, or queen (Q) (i.e., the second subset of rankings), the player positions a wager in the center betting window 43. To wager that the player's first card will be a four, seven, ten, or king (K) (i.e., the third subset of rankings), the player positions a wager in the right betting window 44 of the first wagering area 28. The player may wager on one or more than one of the three subsets.

A determination of whether a player's first optional side bet is successful is dependant on both the player's card and the dealer's card. If the player wagered on a subset to which his first card belongs, the bet is successful unless the dealer's first card or the player's first card is a green ace. More specifically, if the player's first card is a green ace, that player (and only that player) loses the first optional side bet (as well as all other side bets) and any wager is collected by the dealer. If the dealer's first card is a green ace, which is an overriding losing condition unrelated to the player's prediction of a subset, all players lose their wagers on the first side bet (as well as all other side bets). As used herein, "overriding losing condition" means a condition on which the player loses his side bet regardless of whether he correctly predicted the subset of the playing card. If the player elects to make a bet and is successful—that is, if the player selects a subset to which his card belongs and the dealer's card is not a green ace—the dealer pays out at 2:1 on the wager placed in the corresponding betting window for the selected subset. While specific subsets of card rankings are set forth in this embodiment, any variation of the subsets may be employed.

The second optional side bet provides a wagering opportunity based on the identifying color of the first card dealt to the dealer, and, more specifically, whether the dealer's first card will be of the red, white, or blue identifying color. To make this side bet, the player places a wager to the red betting window 48, the white betting window 49, and/or the blue betting window 50 composing the second wagering area 30 that corresponds to his prediction of the identifying color of the dealer's first card. If the player elects to place this optional side bet and is successful—that is, if the player correctly wagers on the identifying color of the dealer's first card and the dealer's first card is not a green ace—the dealer pays out at 2:1 on the successful wager. As noted above, if the dealer's first card is a green ace, all players lose the second optional side bet (and all other side bets). The player may wager on one or more than one of the red, white, and blue betting windows 48-50.

An "identifying color," as used herein, means a color appearing on a card in a manner and/or amount sufficient to make the card identifiable with that color or combination of colors. In the preferred embodiment, each card comprises exactly one color on a white background, although this should not be construed to mean that a card cannot have multiple non-white colors present. While multiple colors may appear on a card—e.g., black outlines of the royal figures of a jack, queen, and king—one color (or combination of colors) is dominant so that it is easily and obviously identifiable with a specific color such that the card would be considered to be that color. For example, in an alternative embodiment, the traditional card suits would be considered to have two identifying colors—red (hearts, diamonds) and black (spades, clubs)—despite that other colors may also appear on the cards.

The third optional side bet provides a wagering opportunity based on the color of the first card dealt to the player, and, more specifically, whether the player's first card will be of the red, white, or blue color. To make this side bet, the player places a wager in the red, left betting window 52, the white, center betting window 53, and/or the blue, right betting window 54 composing the third wagering area 32. If the dealer's first card is a green ace, all players lose the third optional side bet (and all other side bets). If the player elects to bet and is successful—that is, if the player correctly wagers on the color of his first card (and neither the player's first card nor the dealer's first card is a green ace as described above)—the dealer pays out at 2:1 on the successful wager. The player may wager on one or more than one of the red, white, and blue betting windows 52-54.

The fourth optional side bet provides a wagering opportunity based on the card ranking of the player's first card. To make this side bet, the player places a wager in the left betting window 56, center betting window 57, and/or right betting window 58 of the fourth wagering area 34. Specifically, the player may wager that his first card will have a ranking in a first subset of two, three, four, or five by moving a wager amount to the left betting window 56 of the fourth wagering area 34. The player may wager that his first card will have a ranking in a second subset of six, seven, eight, or nine by moving a wager amount to the center betting window 57. Finally, the player may wager that his first card will have a ranking in a third subset of ten, jack (J), queen (Q), or king (K) by moving a wager to the right betting window 58. If the player's first card is a green ace, the player loses the fourth optional side bet. If the dealer's first card is a green ace, all players lose the fourth optional side bet (and all other side bets). If the player bets successfully—that is, if the player correctly wagers on the subset that includes the ranking of his card (and neither the players first card nor the dealer's first card is a green ace)—the dealer pays out at 2:1. The player may wager on one or more than one of the three subsets.

The fifth optional side bet provides the opportunity to wager on whether the player will be successful on each of the first, second, third, and fourth optional side bets. The player may wager that he will be successful on the first through fourth side bets by placing a wager in the fifth wagering area 36. If the player is successful—that is, if the player has wagered on this side bet and has also successfully wagered on each of the first through fourth optional side bets and the dealer's first card is not a green ace—the dealer pays out at 80:1.

A First Alternative Embodiment

Figure 3:
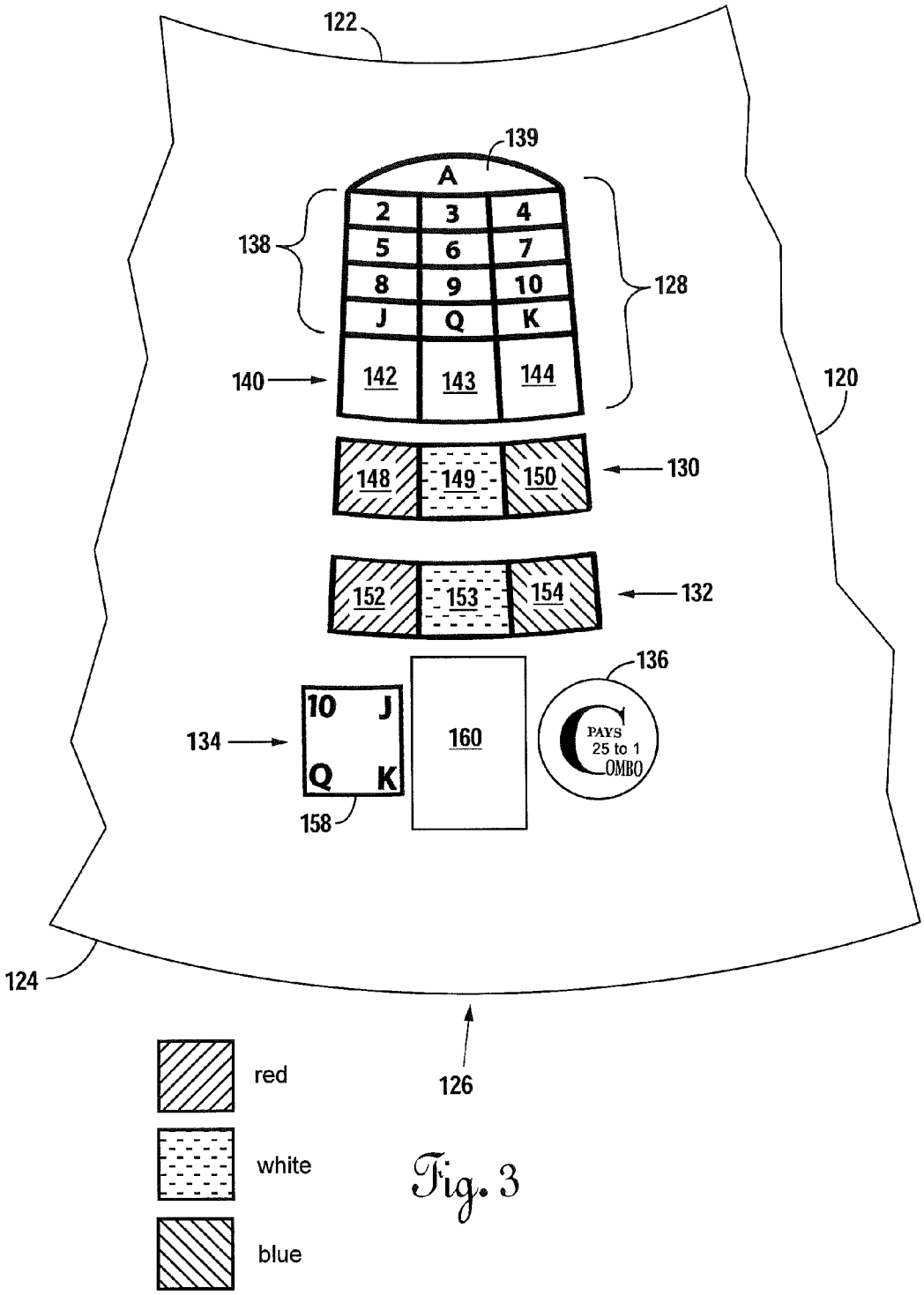
FIG. 3 shows the layout of a gaming table comprising an alternative embodiment of the card game of the present invention.

As shown in FIG. 3, an alternative embodiment of the invention comprises a gaming table 120 having a dealer side 122 and a player side 124, and that provides a number of stations 126 for players to occupy. Each player station 126 of this alternative embodiment comprises a first wagering area 128, a second wagering area 130, a third wagering area 132, a fourth wagering area 134, and a fifth wagering area 136 corresponding to optional first, second, third, fourth and fifth side bets.

The first wagering area 128 is subdivided into fifteen rectangular areas in three columns and five rows. A sixteenth area 139, designated with an "A", extends across, and is adjacent to, the three columns. Each ranking of a traditional card suit is placed in one of thirteen areas composing the second through fifth rows 138 and the sixteenth area 139. The left column includes a first subset of rankings two, five, eight, and jack (J); the center column includes a second subset of rankings three, six, nine, and queen (Q); and the right column includes a third subset of rankings four, seven, ten, and king (K). The first row 140 of the first wagering area 128 is composed of the left, center, and right betting windows 142-144 of the corresponding columns.

The second wagering area 130 comprises three adjacent betting windows 148-150. For aesthetic purposes, each of the windows 148-150 within the second wagering 130 area is aligned with the left, center, or right column composing the first wagering area 128. Each of the windows 148-150 is differently colored: the left window 148 is red, the center window 149 is white, and the right window 150 is blue.

The third wagering area 132 comprises three adjacent betting windows 152-154. For aesthetic purposes, each of the betting windows 152-154 is aligned with the left, center, or right windows 148-150 of the second wagering area 130. Each of the windows 152-154 is differently colored: the left window 152 is red, the center window 153 is white, and the right window 154 is blue.

The Blackjack betting window 160, used for traditional Blackjack wagers, is located between the fourth wagering area 134 and the fifth wagering area 136. The fourth wagering area 134 comprises a betting window 158 containing designations for the rankings of ten, jack (J), queen (Q), and king (K). The circular fifth wagering area 136 is located to the right of and proximal to the Blackjack betting window 160.

In this alternative embodiment, fifty-two cards make up a complete playing deck. The playing deck is divided into four suits each having its own identifying trait selected from the colors of red, white, blue, and green, rather than traditional playing suits (i.e., hearts, clubs, diamonds, and spades). Each suit of the playing deck includes thirteen cards having traditional rankings of ace through king.

As described with reference to the preferred embodiment, this alternative embodiment incorporates the traditional rules of Blackjack. Prior to any cards being dealt, each player is offered the opportunity to optionally make one or more side bets having outcomes determined either directly or indirectly by one or more cards to be dealt to the player and the first card to be dealt to the dealer. After all desired side bets are placed, the players and dealer are dealt the first card of their Blackjack hand face up, after which any side bets that were placed are resolved. Regular Blackjack play then resumes.

The first optional side bet of this embodiment provides a wagering opportunity based on whether the ranking of the player's first card will belong to one of the three subsets of rankings associated with the three columns of the first wagering area 128. Referring to FIG. 2, to wager that the player's first card will have a ranking of two, five, eight, jack (J), or ace (A), the player positions a wager within the left betting window 142 of the first wagering area 128, thus associating the player's wager with that subset of rankings. To wager that the player's first card will be a three, six, nine, queen (Q), or ace (A), the player positions a wager in the center betting window 143, thus associating the player's wager with that subset of rankings. To wager that the player's first card will be a four, seven, ten, king (K), or ace (A), the player positions a wager in the right betting window 144, thus associating the player's wager with that subset of rankings. The player may wager on one or more of the three subsets. However, if the player's first card is a green card (regardless of rank), the player loses the first side bet. If the player elects to make the bet and is successful—that is, if the player correctly wagers on the subset that includes the ranking of his card and the dealer's card is not a green ace—the dealer pays out at 2:1. Any wagers placed on the other two "losing" windows are collected by the dealer.

The second optional side bet provides a wagering opportunity based on the color of the first card dealt to the dealer, and, more specifically, whether the dealer's first card will be of the red, white, or blue color. To make this side bet, the player places a wager in the red left betting window 148, the white center betting window 149, and/or the right blue betting window 150 composing the second wagering area 130. If the dealer's first card is a green card (regardless of ranking), the player loses the second optional side bet. If the player elects to bet and is successful—that is, if the player correctly wagers on the color of the dealer's first card and the dealer's first card is not green—the dealer pays out at 2:1 on the successful wager.

The third optional side bet provides a wagering opportunity based on the color of the first card dealt to the player, and, more specifically, whether the player's first card will be of the red, white, or blue color. To make this side bet, the player places a wager in the red betting window 152, the white betting window 153, and/or the blue betting window 154 composing the third wagering area 132. If the player's first card is green, that player loses the third optional side bet (and all other side bets). If the player elects to bet and is successful—that is, if the player correctly wagers on the color of his first card and his first card is not green—the dealer pays out at 2:1 on the successful wager. The player may wager on one or more than one of the red, white, or blue windows.

The fourth optional side bet provides a wagering opportunity based on the card ranking of the player's first card and second card—i.e., the initial Blackjack hand. The player may only make this side bet if the player is dealt an ace on his first card. Thereafter, the player places a wager in the betting window 158 of the fourth wagering area 134 to wager that his second card will be a ten, jack (J), queen (Q), or king (K)—i.e., that his second card will result in his hand being a Blackjack. If the player's first card is green (regardless of rank), the player loses the fourth optional side bet. If the player bets successfully—that is, if the player correctly wagers on the subset of ten, jack (J), queen (Q), or king (K) and his second card is a ten, jack (J), queen (Q), or king (K) and is not green—the dealer pays out at 1:1.

A fifth optional side bet provides the opportunity to wager on the player's successful completion of each of the first, second, and third optional side bets of this alternative embodiment. A player may wager that he will be successful on the first through third side bets by placing a wager into the fifth wagering area 136. If the player is successful—that is, if the player has successfully wagered on each of the first through third optional side bets—the dealer pays out at 25:1.

A Second Alternative Embodiment

Figure 4:
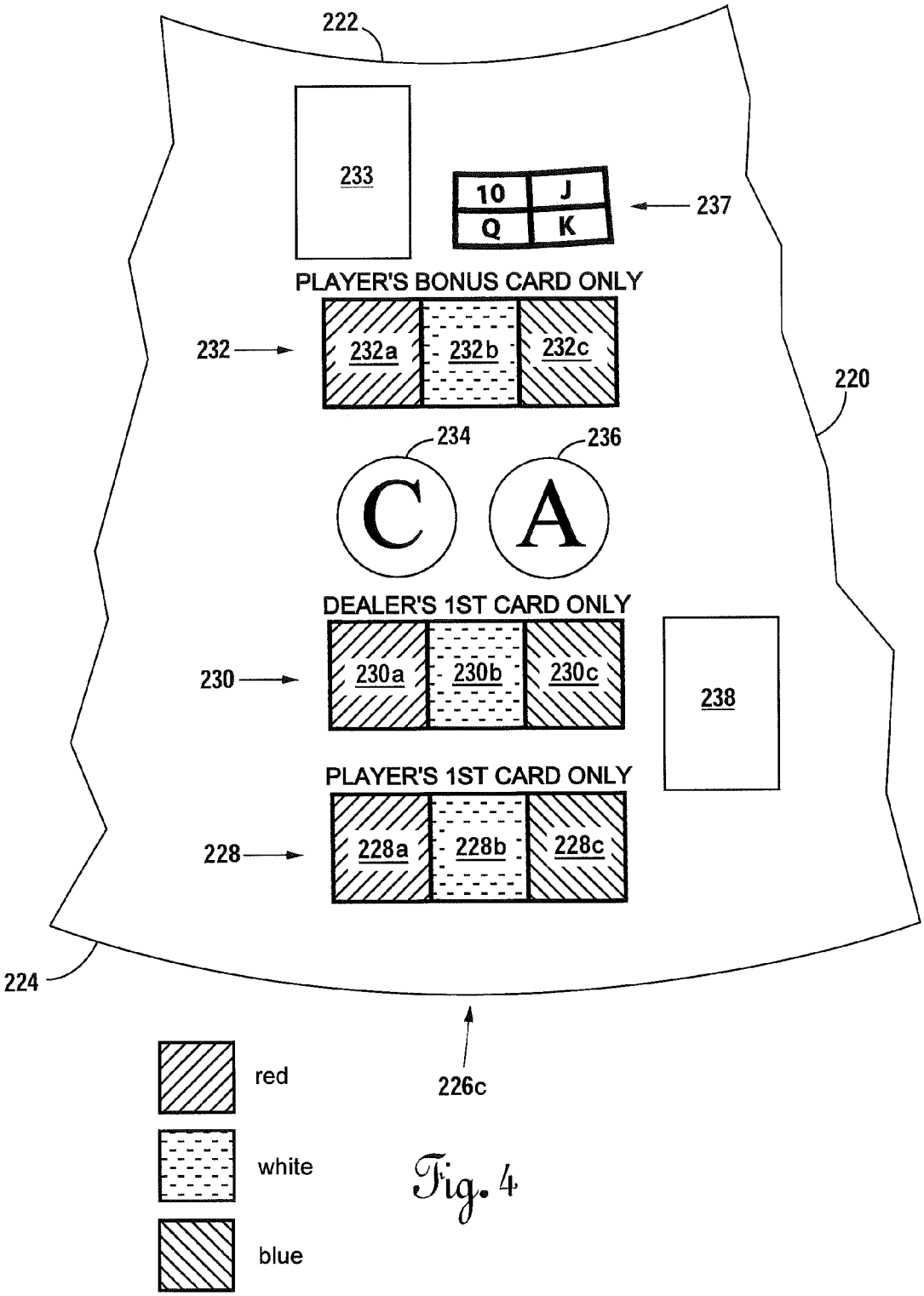
FIG. 4 shows the layout of a gaming table of yet another embodiment of the present invention.

As shown in FIG. 4, yet another alternative embodiment of the invention comprises a gaming table 220 having a dealer side 222 and a player side 224, and that provides a number of player stations 226, such as player station 226*c*, for players to occupy. Each player station 226 of this alternative embodiment comprises a first wagering area 228, a second wagering area 230, a third wagering area 232, a fourth wagering area 234, and a fifth wagering area 236 corresponding to optional first, second, third, fourth, and fifth side bets, each of which is dependant on correctly predicting an identifying trait of one or more of the player's first card of a blackjack hand, the dealer's first card of the house's blackjack hand, and a bonus card dealt to the player. In addition, a sixth wagering area 237 corresponds to an additional bet that is determined by the player's first two cards of the player's blackjack hand, as will be described. A Blackjack betting window 238, used for traditional Blackjack wagers, is located proximal to the first and second wagering areas 228, 230. A "bonus" window 233, or "bonus box," is positioned between the dealer side 222 of the table 220 and the third wagering area 232, with one bonus box associated with each player station 226 at the table. Each of the first wagering area 228, second wagering area 230, and third wagering area 232 are divided into sub-areas. The first wagering area 228 is divided into three sub-areas 228*a-c*, which are colored red, white, and blue, respectively. The second wagering area 230 is subdivided into three sub-areas 230*a-c*, which are colored red, white, and blue, respectively. The third wagering area 232 is subdivided into three sub-areas 232*a-c*, which are colored red, white, and blue, respectively.

In this embodiment, thirty-nine cards make up a complete playing deck, which is divided into three suits (each suit having thirteen cards of the traditional rankings of ace through king), with all cards of each suit except the ace having a common identifying trait that is one of the colors of red, white, and blue. The ace of each suit, however, is a fourth identifying trait that is the color green. Thus, the ratio of the number of cards having a fourth identifying trait to the number of cards having one of the first, second and third identifying traits—red, white, and blue, respectively—is 1:13.

Although this specific embodiment contemplates the use of red, white, blue, and green as set forth above, any other combination of colors (or for that matter, any other type of identifying traits) is acceptable, provided that (i) the identifying colors preferably are quickly distinguishable from one another; (ii) a specific color is not used in more than one window in a single wagering area; and (iii) the identifying colors of the cards correspond to the colors used to identify the betting windows within the wagering areas when applicable—i.e., in this embodiment, the first, second and third wagering areas 228, 230, 232.

As with the preferred embodiment, this alternative embodiment incorporates the traditional rules of Blackjack. Prior to any cards being dealt, each player is offered the opportunity to optionally make one or more side bets having outcomes determined either directly or indirectly by one or more cards to be dealt to the player and one card dealt to the dealer. After all desired wagers are placed, the first card of the deck is "burned," or discarded. Next, a "bonus" card is dealt to each player's bonus card window 233 irrespective of whether there is a player at a station—i.e., if the gaming table 220 has five stations, but only station 226*c* is occupied, five bonus are still dealt. After the "bonus" cards are dealt, the players and dealer are dealt the first card of their Blackjack hand face up, after which any side bets that were placed are resolved. Regular Blackjack play then resumes.

Prior to describing the optional side bets in detail, it should be noted that each of the optional side bets has two overriding partial losing conditions. First, if the player's first card belongs to the fourth identifying trait—that is, at least in this embodiment, the player's first card is green—the player will lose half of the amount wagered by that player on each of the five optional side bets. Second, if the dealer's first card belongs to the fourth identifying trait, the player will also lose have the amount wagered by that player on each of the five option side bets. If both the player's first card and the dealer's first card have the fourth identifying trait, the player still only loses one-half of the wagered amounts. In both cases, the dealer does not pay the player regardless if the bet would otherwise be successful. Also in both cases, the player does not lose the entire wager if the bet would have otherwise been unsuccessful.

The first optional side bet of this embodiment, which is associated with the first wagering area 228, provides a wagering opportunity based on whether the identifying trait (e.g., color) of the player's first card will belong to one of the three traits (e.g., red, white or blue) associated with the three subareas 228*a-c* of the first wagering area 228. Referring to FIG. 4, to wager that the player's first card will be red, white, or blue, the player positions a wager within one or more of the subareas 228*a-c* of the first wagering area 228, thus associating the player's wager with that sub-area. The player may wager on one or more of the three traits. However, if the player's first card is a green card (i.e., an ace), the player loses half of the amount wagered on the first side bet (as well as all other four side bets). If the player elects to make the bet and is successful—that is, if the player correctly wagers on the color of his first card and the dealer's first card is not a green ace—the dealer pays out at 2:1. Any wagers placed on the other two "losing" windows are collected by the dealer.

The second optional side bet, which is associated with the second wagering area 230, provides a wagering opportunity based on the color of the first card dealt to the dealer, and, more specifically, whether the dealer's first card will have the first identifying trait, the second identifying trait, or the third identifying trait (e.g., red, white, or blue color). To make this side bet, the player places a wager in the red left betting window 230*a*, the white center betting window 230*b*, and/or the right blue betting window 230*c* composing the second wagering area 230. If the dealer's first card is a green card (i.e., an ace), the player loses half of the amount wagered on the second optional side bet (as well as all other four side bets). If the player elects to bet and is successful—that is, if the player correctly wagers on the color of the dealer's first card and the player's first card is not green—the dealer pays out at 2:1 on the successful wager.

The third optional side bet, which is associated with the third wagering area 232, provides a wagering opportunity based on the color of the bonus card dealt in the player's bonus box, and, more specifically, whether the player's bonus card is associated with one of the windows 232*a-c* of the third wagering area 232. To make this side bet, the player places a wager in the red betting window 232*a*, the white betting window 232*b*, and/or the blue betting window 232*c* composing the third wagering area 232. If the player's first card or the dealer's first card is green, that player loses half of the amount wagered on the third optional side bet (as well as all other four side bets). If the player elects to bet and is successful—that is, if the player correctly wagers on the color of the bonus card and neither the dealer's first card nor the player's first card is green—the dealer pays out at 2:1 on the successful wager. The player may wager on one or more than one of the red, white, or blue traits. The bonus card is not used as part of the player's or dealer's blackjack hand.

The fourth optional side bet, which is associated with the fourth wagering area 234, provides a wagering opportunity based on the player's first card, dealer's first card, and player's bonus card. To make this bet, the player places a wager in the fourth wagering area 234 and a marker in a single window of each of the first wagering area 228, second wagering area 230, and third wagering area 232. Regardless of whether the player elects to make one or more of the first side bet, second side bet, and third side bets, the player may make this optional side bet. Ultimately, there are twenty-seven possible combinations of marker placement for this bet. If the player correctly predicts the identifying trait of each of the player's first card, dealer's first card, and the player's bonus card (which means the overriding partial losing conditions would not apply) the dealer pays 25:1. In addition, the overriding partial losing conditions apply to this fourth optional side bet.

A fifth optional side bet, which is associated with the firth wagering area 236, provides the opportunity to wager that the player's first card is an ace. To make this wager, the player places a wager in the fifth wagering area 236. If the player is successful, the dealer pays out at 11:1, provided, however that if the dealer's first card is also an ace, the wager is a push—i.e., the player neither wins nor loses this side bet. In addition, the overriding partial losing conditions apply to this fifth optional side bet.

Another bet provides the opportunity to wager that the player's second card will be a ten, jack, queen or king. The player's first card must be an ace for this bet to be available. If the first card dealt face up in a player's betting station is an ace, the player then has the option to wager up to half of the original wager that the second card dealt will result in a blackjack. To make this wager, if the player's first card is an ace, the player may place up to half of the original Blackjack wager in the sixth wagering area 237. If the wager is successful, the wager is paid out at odds of 2:1. Depending upon the rules of the casino, if the second card dealt face up is another ace, the aces may be split again, following the same set of rules as for a single Ace. This new bet does not change the mathematical probability of the game of blackjack.

Other Alternative Embodiments

The technology of the present invention may be played as a real casino table card game with physical playing cards, live dealer, and chips. The technology may also be played as a completely electronic game on a single video gaming platform (similar to commercially available video poker or video blackjack formats, with the game controller and processor content enabling play according to the rules described herein) or on a multi-player all electronic gaming platform as disclosed in U.S. Publication No. 2005/0164759 A1, assigned to Shuffle Master, Inc., which is incorporated by reference herein. Alternatively, a blended physical and electronic gaming system may be used, such as described in U.S. Publication No. 2010/0004042, which is incorporated by reference herein. Either physical cards (with a live dealer) and electronic only wagering are used, or physical cards with electronic card displays and electronic wagering may be used, or systems using physical chips and virtual cards (with a live dealer) and other combinations of physical elements of a standard live casino table wagering game and electronic support may be used.

Such electronic systems would have at least a monitor for view by players, either as a single monitor or individual monitors at each player position. A game controller would effect execution of the rules of the game, and possibly handle all accounting information, or the accounting functions could be separately supported on a table processor or a central processor. Playing cards in a physical game may be manually shuffled or a single deck or multi-deck playing card shuffler may be used. All-Electronic multiplayer systems such as those described in U.S. Publication Nos. 2004/0224777 and 2005/0164762 may be used, and these applications and all other documents referenced herein are incorporated by reference. User input means for receiving the player input into the processor may include one or more of a keyboard, buttons, a pointing device (e.g., a mouse, a stylus, finger, etc.), a touch screen, an audio input device coupled to voice recognition software, and the like.

Alternative formats for play could be performed on internet connections, internal casino networks or inter-casino networks, hand-held gaming devices, and hand-held wireless communication devices that operate in a slave-master or server-client relationship with a processor operating the game. Games may be played using actual monetary wagers or may use non-monetary credit wagering for practice play or pure entertainment purposes. The games may be played as a communal game, with all players wagering on a single common event (as described in U.S. patent application Ser. No. 11/595,738, filed Nov. 20, 2006 and U.S. Ser. No. 10/660,963 filed Sep. 12, 2003, each of which is incorporated herein by reference). In electronic versions of the invention, the playing surface may be physical or virtual.

The present invention is described in terms of a preferred illustrative embodiment of a specifically described card game and method, as well as alternative embodiments thereof. Those skilled in the art will recognize that yet other alternative embodiments of such a game and method can be used in carrying out the present invention. Other aspects, features, and advantages of the present invention may be obtained from a study of this disclosure and the drawings, along with the appended claims.

I claim:

1. An electronic gaming system for playing a modified Blackjack game between a dealer and a player, the system comprising:

at least one video monitor;

a processor coupled to the at least one video monitor;

a computer-readable medium coupled to the processor;

a player input means for receiving user input from at least one player, said player input means being coupled to said processor;

a set of processor-readable instructions embodied in said computer-readable medium, said set of instructions operative to:

offer the player at least one side bet having an outcome dependant upon whether a card yet to be dealt will belong to at least one player-selected subset of a first set of identifying traits consisting of a first identifying trait, a second identifying trait, and a third identifying trait;

receive player input with said player input means, said player input comprising data representative of the player's acceptance or non-acceptance of said at least one side bet, associated selections of subsets, and wagered amounts;

deal a bonus card to the player from at least one deck of cards consisting of thirty-nine cards, wherein each card in a deck has a card ranking in addition to an identifying trait that is a subset of a second set of identifying traits consisting of said first identifying trait, said second identifying trait, said third identifying trait, and a fourth identifying trait;

deal a first card from said at least one deck of cards to the player;

deal a second card from said at least one deck of cards to the dealer;

determine whether each accepted side bet was successful;

for each successful side bet, pay a predetermined payout to the associated player; and for each unsuccessful side bet, collect the player's wager;

deal a third card from said at least one deck of cards to the player;

deal a fourth card from said at least one deck of cards to the dealer;

complete a Blackjack game between the player and the dealer, wherein the player's Blackjack hand comprises the first card and the third card and the dealer's Blackjack hand comprises the second card and fourth card;

wherein said deck of cards consists of a first group of twelve cards having said first identifying trait; a second group of twelve cards having said second identifying trait; a third group of twelve cards having said third identifying trait; and a fourth group of three cards having a fourth identifying trait, and wherein each card of a deck belongs to exactly one group of said first group, said second group, said third group, and said fourth group.

2. The system of claim 1 wherein said at least one side bet comprises a first side bet having an outcome dependant upon whether a card yet to be dealt to the dealer will belong to a one-trait subset of said first set of identifying traits.

3. The system of claim 2 wherein said at least one side bet comprises a second side bet having an outcome dependant upon whether a card yet to be dealt to the player will belong to a one-trait subset of said first set of identifying traits.

4. The system of claim 3 wherein said at least one side bet comprises a third side bet having an outcome dependant upon whether a card yet to be dealt to the player will belong to a one-trait subset of said first set of identifying traits.

5. The system of claim 4 wherein said set of instructions is operative to offer the player a fourth side bet having an outcome dependant upon whether the player is successful on the player's first side bet, second side bet, and third side bet.

6. The system of claim 5 wherein said set of instructions is operative to offer the player a fifth side bet having an outcome dependant on whether the player's first card has said fourth identifying trait.

7. The system of claim 1 wherein each card is a virtual card.

8. The system of claim 1 wherein said dealer is a virtual dealer.

* * * * *